US006933769B2

(12) United States Patent
Koelling

(10) Patent No.: US 6,933,769 B2
(45) Date of Patent: Aug. 23, 2005

(54) BANDGAP REFERENCE CIRCUIT

(75) Inventor: Jeffrey Koelling, Fairview, TX (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/648,076

(22) Filed: Aug. 26, 2003

(65) Prior Publication Data

US 2005/0046466 A1 Mar. 3, 2005

(51) Int. Cl.[7] ..... G05F 1/10
(52) U.S. Cl. ..... 327/538
(58) Field of Search ..... 323/315, 316; 327/512, 513, 530, 534, 535, 538, 539, 540, 541, 543

(56) References Cited

U.S. PATENT DOCUMENTS

| | | | | | |
|---|---|---|---|---|---|
| 3,641,422 | A | | 2/1972 | Farnsworth | 323/224 |
| 3,806,791 | A | | 4/1974 | Johnson | 321/2 |
| 4,388,537 | A | | 6/1983 | Kanuma | 307/297 |
| 4,443,753 | A | | 4/1984 | McGlinchey | 327/535 |
| 4,714,877 | A | | 12/1987 | Kong | 324/133 |
| 4,716,307 | A | | 12/1987 | Aoyama | 327/543 |
| 4,731,574 | A | | 3/1988 | Melbert | 323/275 |
| 4,808,905 | A | | 2/1989 | Chen et al. | 323/222 |
| 4,928,056 | A | | 5/1990 | Pease | 327/535 |
| 5,038,053 | A | * | 8/1991 | Djenguerian et al. | 327/513 |
| 5,045,806 | A | | 9/1991 | Yan | 330/252 |
| 5,051,686 | A | | 9/1991 | Schaffer | 327/535 |
| 5,061,862 | A | | 10/1991 | Tamagawa | 307/296.1 |
| 5,065,361 | A | | 11/1991 | Yoshizawa et al. | 365/185.23 |
| 5,077,518 | A | | 12/1991 | Han | 323/275 |
| 5,119,015 | A | | 6/1992 | Watanabe | 323/313 |
| 5,229,710 | A | | 7/1993 | Kraus et al. | 37/296 |
| 5,253,201 | A | | 10/1993 | Atsumi et al. | 365/185 |
| 5,264,808 | A | | 11/1993 | Tanaka | 331/57 |
| 5,268,871 | A | | 12/1993 | Dhong et al. | 365/226 |
| 5,446,367 | A | | 8/1995 | Pinney | 323/266 |
| 5,448,199 | A | | 9/1995 | Park | 327/546 |
| 5,493,234 | A | | 2/1996 | Oh | 326/33 |
| 5,508,604 | A | | 4/1996 | Keeth | 323/314 |
| 5,530,640 | A | | 6/1996 | Hara et al. | 363/60 |
| 5,598,122 | A | | 1/1997 | McClure | 327/530 |
| 5,602,506 | A | | 2/1997 | Kim et al. | 327/535 |
| 5,721,510 | A | | 2/1998 | Miyajima | 327/536 |
| 5,744,997 | A | | 4/1998 | Kang et al. | 327/537 |
| 5,747,974 | A | | 5/1998 | Jeon | 323/269 |
| 5,757,211 | A | | 5/1998 | Phillips | 327/73 |
| 5,801,552 | A | | 9/1998 | Moore | 327/62 |
| 5,811,993 | A | | 9/1998 | Dennard | 327/54 |
| 5,814,980 | A | | 9/1998 | Lewis | 323/311 |
| 5,945,869 | A | | 8/1999 | Koelling | 327/534 |
| 5,994,950 | A | | 11/1999 | Ochi | 327/543 |
| 6,037,762 | A | | 3/2000 | Koelling et al. | 323/313 |
| 6,107,866 | A | * | 8/2000 | Migliavacca | 327/539 |
| 6,111,456 | A | | 8/2000 | Saito et al. | 327/541 |
| 6,297,671 | B1 | | 10/2001 | Shih et al. | 327/74 |
| 6,400,213 | B2 | | 6/2002 | Shih et al. | 327/540 |
| 6,437,614 | B1 | * | 8/2002 | Chen | 327/143 |
| 6,512,705 | B1 | | 1/2003 | Koelling et al. | 365/189.11 |
| 6,624,685 | B2 | | 9/2003 | Shih et al. | 327/541 |
| 6,737,849 | B2 | * | 5/2004 | Eshraghi et al. | 323/315 |
| 6,783,274 | B2 | * | 8/2004 | Umeyama et al. | 374/178 |

* cited by examiner

*Primary Examiner*—Jeffrey Zweizig
(74) *Attorney, Agent, or Firm*—Schwegman, Lundberg, Woessner & Kluth, P.A.

(57) ABSTRACT

A reference circuit generates a reference voltage from a supply voltage. The reference circuit includes a current generating unit for generating generated currents. An output unit of the reference circuit generates the reference voltage based on the generated currents. A startup unit of the reference circuit allows the reference voltage to switch between different voltages levels in different modes.

61 Claims, 10 Drawing Sheets

BANDGAP REFERENCE CIRCUIT

FIELD

The present invention relates generally to reference circuits, and more particularly to reference circuits that provide substantially constant signals.

BACKGROUND

Many electrical devices have a reference circuit for generating a reference signal based on an external source for internal use. The external source is often a supply voltage. The reference signal may represent either a reference current or a reference voltage. The reference circuit is usually designed such that the reference signal has a constant level over variations in the supply voltage, over a range of temperature, and over manufacturing process variations.

In most devices, the supply voltage is sufficient such that designing the reference circuit faces little problem. However, in devices where a reduced supply voltage is preferable, generating the reference voltage using traditional designs may encounter difficulty.

SUMMARY OF THE INVENTION

The present invention provides techniques to generate a reference voltage with a reduced supply voltage. The reference voltage is independent from variations in the supply voltage, from a range of temperatures, and from manufacturing process variations.

One aspect includes a reference circuit having a current generating unit for generating a generated current. The reference circuit also includes an output unit for producing an output current based on the generated current. The output unit also produces a reference voltage based on the output current. The reference circuit further includes a startup unit for allowing the reference voltage to switch between different stable voltage levels when the reference circuit enters different modes.

Another aspect includes a method of generating a bandgap reference voltage. The method includes sourcing a first current using a first transistor connected to a supply node, and passing the first current through a first control transistor connected to a second supply node. The method also includes sourcing a second current using a second transistor connected to the first supply node, and passing the second current through a combination of a second control transistor and a resistive element connected to the second supply node. The method further includes generating an output current based on the first and second currents, and generating the bandgap reference voltage based on the output current.

DETAILED DESCRIPTION OF THE EMBODIMENTS

Figure 1:
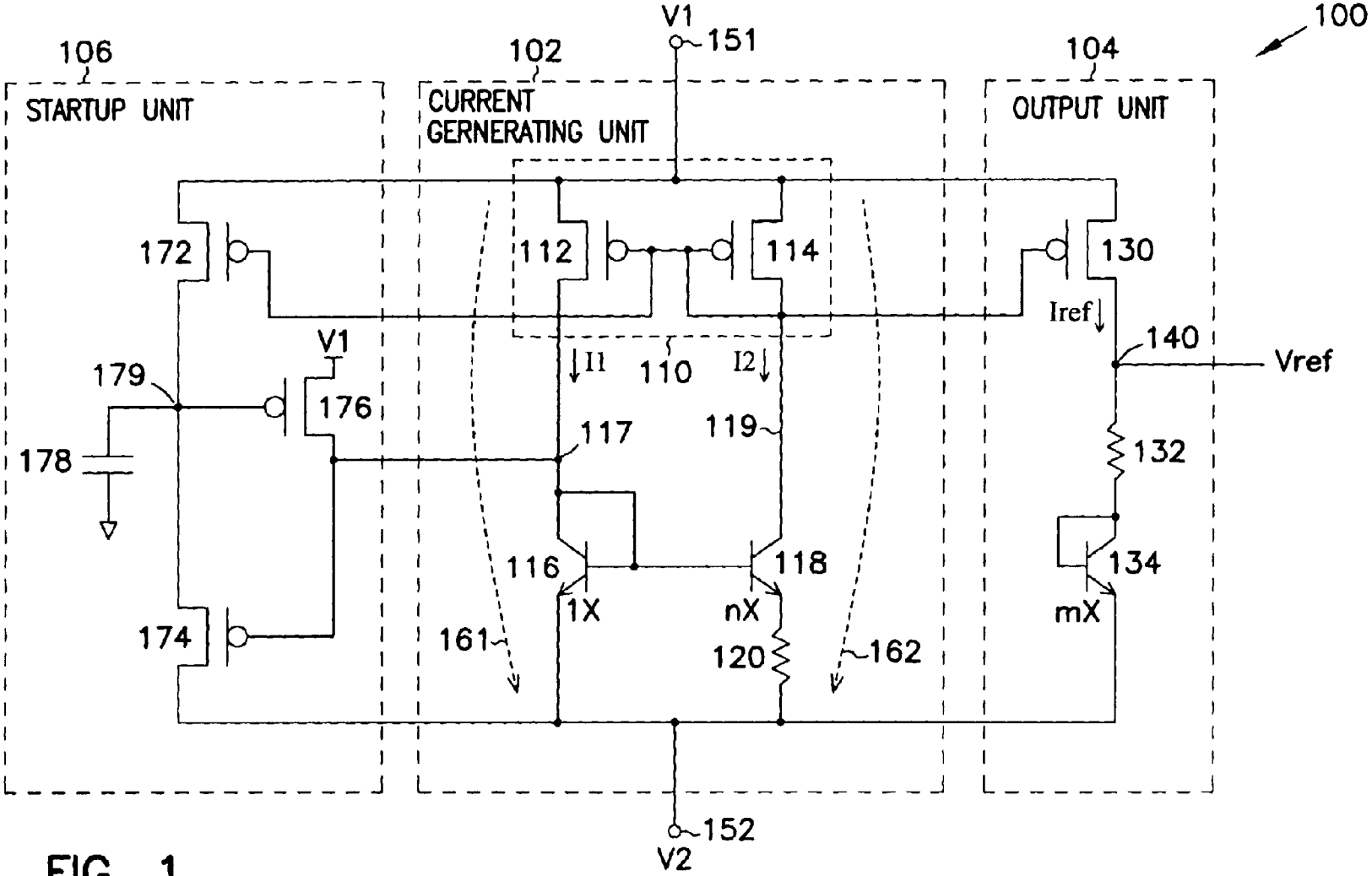
FIG. 1 shows a reference circuit according to an embodiment of the invention.

The following description and the drawings illustrate specific embodiments of the invention sufficiently to enable those skilled in the art to practice the invention. Other embodiments may incorporate structural, logical, electrical, process, and other changes. In the drawings, like numerals describe substantially similar components throughout the several views. Examples merely typify possible variations. Portions and features of some embodiments may be included in or substituted for those of others. The scope of the invention encompasses the full ambit of the claims and all available equivalents.

FIG. 1 shows a reference circuit according to an embodiment of the invention. Reference circuit 100 includes a current generating unit 102, an output unit 104, and a startup unit 106. Unit 102 generates currents I1 and I2 (generated currents). Output unit 104 produces a current Iref (reference current or output current) based on I1 and I2 and produces a voltage Vref (reference voltage or output voltage) at output node 140. Vref has a first stable voltage level and a second stable voltage level higher than the first stable voltage level. Startup unit 106 allows Vref to switch between the first and second stable voltage levels at a certain time. For example, at a power-up time of circuit 100, startup unit 106 allows Vref to switch from an initial level (e.g. the first stable voltage level) to a second level (e.g. the second stable voltage level). After Vref reaches the second voltage level, startup unit 106 does not directly influence the operation of circuit 100.

In some embodiments, Vref is a bandgap reference voltage; it is stable over both a temperature range and variations in voltages at supply nodes 151 and 152. As is known in the art, a bandgap voltage of a semiconductor is the energy (voltage or potential) difference between the bottom of the conduction band and the top of the valance band of the semiconductor. In some embodiments, the components of reference circuit 100 are made of silicon such that Vref is a bandgap voltage of silicon. Other embodiments exist where the components of reference circuit 100 are made of other materials besides silicon such that Vref is a bandgap voltage of the other materials.

Supply node 151 receives a supply voltage V1. Supply node 152 receives a supply voltage V2. In some embodiments, V1 represents a first voltage rail and V2 represents a second voltage rail. In other embodiments, V1 is a positive voltage and V2 is ground. In some other embodiments, V1 is a positive voltage and V2 is a negative voltage.

Current generating unit 102 includes control transistors 116 and 118, a control resistive element 120, and a current mirror 110 formed partially by current source transistors 112 and 114. In embodiments represented by FIG. 1, resistive element 120 includes a resistor. In some embodiments, resistive element 120 includes a variable resistor.

Each transistor in current mirror 110 provides a current in one of two "legs" in the circuit. For example, transistor 112 provides current I1 in one leg of the current mirror, and transistor 114 provides current 12 in another leg of the current mirror.

Transistors 112 and 116 form a current path 161 between supply nodes 151 and 152 in which current I1 flows. Transistors 114 and 118 and resistor 120 form another current path 162 between supply nodes 151 and 152 in which current 12 flows.

I1 and I2 are substantially equal. In some embodiments, transistors 112 and 114 are sized such that currents I1 and I2 are related, but are not equal. For example, I1 and I2 are proportional. Many embodiments of current mirrors 110 exist. In some embodiments, current mirror 110 is implemented with bipolar transistors. In other embodiments, current mirror 110 is implemented with field effect transistors (FET). In embodiments represented by FIG. 1, current mirror 102 is implemented with p-channel metal oxide semiconductor field effect transistors (PMOSFET or PMOS) 112 and 114.

Transistor 116 connects as a diode between an internal node 117 and supply node 152. Transistor 118 and resistor 120 connect in series between an internal node 119 and supply node 152. Transistor 116 has a size of 1X. Transistor 118 has a size of nX, where X is the size of transistor 116 and n is a multiplier; n is a real number. Thus, in embodiments where n is an integer greater than one, the size of transistor 118 is n times the size of transistor 116. For example, if n equals eight then size of transistor 118 is eight times the size of transistor 116.

In some embodiments, the size X of transistor 116 is measured by the cross-sectional area of the emitter of transistor 116. For example, if n equals eight then the cross-sectional area of the emitter of transistor 118 is eight times the cross-sectional area of the emitter of transistor 116. The cross-sectional area is a plane perpendicular to the current flowing through the cross-sectional area. In some embodiments, the cross-sectional area of the emitter of transistor 116 is between six square microns and ten square microns.

In embodiments where I1 and I2 are equal and the cross-sectional areas of the emitters of transistors 116 and 118 are unequal, the current densities passing through transistors 116 and 118 are unequal because of equal current passing through unequal cross-sectional areas. For example, when I1 and I2 are equal and n is greater than one, the current density passing through transistor 116 is greater the current density passing through transistor 118. Different current densities allow circuit 100 to generate Vref with a constant value at a certain value of V1 at node 151.

Output unit 104 includes output transistor 130, an output resistive element 132, and an output control transistor 134. Transistor 130 connects to current mirror 110 to produce Iref, the reference current (or output current). In FIG. 1, transistor 130 is sized such that Iref is substantially equal to I1 or I2. In some embodiments, transistors 130, 112, and 114 are sized such that Iref, I1, and I2 are related, but are not equal. For example, Iref is proportional to I1 or Iref is proportional to I2. Iref flows through resistive element 132 and transistor 134, which connect in series between output node 140 and supply node 152.

In embodiments represented by FIG. 1, resistive element 132 includes a resistor. In some embodiments, resistive element 132 includes a variable resistor. Transistor 134 has a size of mX, where X is the size of transistor 116 and m is a multiplier; m is a real number. In embodiments represented by FIG. 1, m equals one, thus transistors 134 and 116 have an equal size. In some embodiments, m can be different from one. Transistor 134 connects as a diode between resistor 132 and node 152. Vref is the sum of the voltages across resistor 132 and transistor 134. Vref is referenced to V2 at node 152. As described above, V2 can be ground or a negative voltage.

The structure of reference circuit 100 allows Vref to be independent from variations in V1 or V2, from a temperature range, and from manufacturing process variations. Reference circuit 100 has elements that produce a voltage (potential) with a positive temperature coefficient and elements that produce a voltage with a negative temperature coefficient. The voltage with a positive temperature coefficient increases when the temperature increases. The voltage with a negative temperature coefficient decreases when the temperature increases. When these voltages are (combined) while the temperature changes within a certain temperature range, the increase and decrease in these voltages (due to a change in temperature) cancel each other. Thus, the sum of these voltages is constant over a temperature range. In embodiments represented by FIG. 1, the sum of these voltages is made equal to the bandgap potential of the material (e.g. silicon) of transistors 116, 118, and 134. In most cases, the bandgap potential of the material of transistors 116, 118, and 134 is independent over a range of temperatures. Thus, the sum of these voltages is also independent (constant or stable) over a temperature range.

Transistors 116, 118, 134 and resistors 120 and 132 are constructed and arranged such that they produce a voltage with a positive temperature coefficient and a voltage with a negative temperature coefficient. The sum of these two voltages is represented as by Vref. Thus, Vref is independent from V1 or V2 and independent from a temperature range.

In embodiments represented by FIG. 1, the voltage with a positive temperature coefficient is created by a combination of transistors 116, 118 and resistor 120. The voltage with a negative temperature coefficient is created a combination of transistor 134 and resistor 132.

Each of the transistors 116 and 118 has a base-to-emitter voltage ($V_{BE}$). The base-to-emitter voltages of transistors 116 and 118 can be made unequal by constructing transistors 116 and 118 with different sizes such as difference in the cross-sectional areas of the emitters as explained above. When $V_{BE}$ of transistor 116 and $V_{BE}$ of transistor 118 are unequal, there exists a $\Delta V_{BE}$ (delta $V_{BE}$), which is the difference between $V_{BE}$ of transistor 116 and $V_{BE}$ of transistor 118. This $\Delta V_{BE}$ has a positive temperature coefficient.

Transistor 134 also has a base-to-emitter voltage $V_{BE}$, which has a negative temperature coefficient. Resistors 120 and 132 can be sized such that Vref is constant at a certain value based on the combination of the positive temperature coefficient of $\Delta V_{BE}$ of transistors 116 and 118 the negative temperature coefficient of $V_{BE}$ of transistor 134.

In embodiments represented by FIG. 1, Vref remains constant at about 1.25 volts (second stable voltage level) within a temperature range of −25° C. to 100° C., V1 is at about 1.3 volts, and V2 is ground. In some embodiments, the second stable voltage level of Vref can remain constant (fixed) at any voltage within a voltage range of about 1.1 volts to about 1.3 volts, within a temperature range of −25° C. to 100° C., and with V1 at about 1.5 volts and V2 is ground (zero volts).

In some embodiment, Vref is at the first stable voltage level when circuit 100 is in an inactive mode (power-down mode, standby mode, or "off" state) and Vref is at the second stable voltage level when circuit 100 is in an active mode (power-up mode, or "on" state). In some embodiments, the first stable voltage level is ground and the second voltage level is selected to be a fixed value within a range of about 1.1 to about 1.3 volts.

Startup unit 106 includes transistors 172, 174, and 176 and a capacitor 178. Startup circuit 106 allows Vref to switch from a first stable voltage level to a second stable voltage level when circuit 100 switches from the inactive mode to the active mode. In some embodiments, the first stable voltage level is ground when circuit 100 is in the inactive mode and the second stable voltage level can be a selected voltage within a range of 1.1 volts to 1.3 volts. The inactive mode occurs when no power is applied to circuit 100, for example, when V1 is zero volts. The active mode occurs when a power is applied to circuit 100, for example, when V1 is a positive voltage.

Startup circuit 106 has at an initial state when circuit 100 is in the inactive mode. In the initial state, no current flows in circuit 100, i.e., I1 and I2 are zero and capacitor 178 holds node 179 at ground. Capacitor 178 and transistor 176 form a combination to influence currents I1 and I2. When circuit 100 switches from the inactive state to the active state, transistor 176 turns on connecting node 117 to V1. Transistor 116 turns on and causes transistor 118 to turn on. Node 119 is pulled to a low voltage when transistor 118 turns on, causing transistor 114 to turn on. Transistors 112 and 172 also turn on. I1 and I2 start to flow. When transistor 172 turns on, it connects node 179 to V1, causing transistor 176 to turn off. As a result, startup unit 106 is electrically disconnected from current generating unit 102.

As long as circuit 100 is in the active state, I1 and I2 continue to flow and Vref remains at a stable voltage level, for example, at the second stable voltage level. Startup unit 106 has no substantially influence on current generating unit 102 when Vref remains at the second stable voltage level. Vref switches to another stable voltage level (e.g., ground) when circuit 100 switches to the inactive state (when power is disconnected from circuit 100 or when V1 is zero and V2 is zero).

In some embodiments, transistor 174 has a channel length greater (longer) than a channel length of any one of the transistors 172 and 176. Greater channel length allows transistor 174 to quickly and effectively transfer the charge at node 179 and at capacitor 178 to ground when the power is disconnected from circuit 100. When node 179 is at ground, startup unit 106 is reset to the initial state to enable transistor 176 to quickly turn on when power is again connected (applied) to circuit 100. In some embodiments, the channel length of transistor 174 is about eight hundred times the channel length of transistor 172 or 176. In one example, the channel length of transistor 172 or 176 is between about 0.12 micron and about 0.25 micron.

The long channel of transistor 174 also keeps the current flowing through transistor 174 relatively smaller than the current flowing through transistor 172. Thus, transistor 172 can keep the voltage at node 179 close to V1 to turn off transistor 176. When transistor 176 turns off, it effectively disconnects startup unit 106 from current generating unit 102 after I1 and I2 start to flow and Vref reaches the second stable voltage level.

Figure 2:
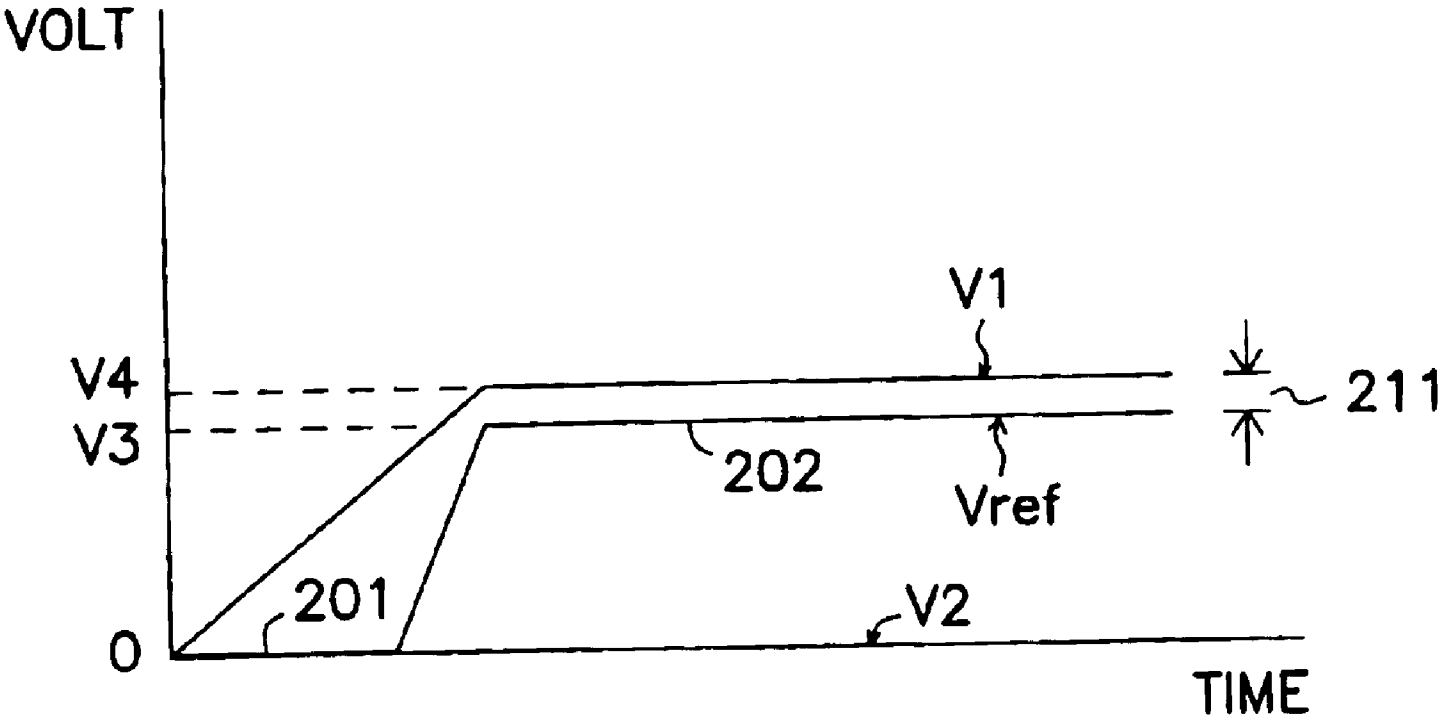
FIG. 2 is a graph showing a relationship between a reference voltage and a supply voltage of the reference circuit of FIG. 1.

FIG. 2 is a graph showing a relationship between a reference voltage and a supply voltage of the reference circuit of FIG. 1. In FIG. 2, Vref has a first stable voltage level 201 and a second stable voltage level 202. Stable voltage level 201 is zero. V3 represents a voltage of stable voltage level 202. V4 represents a voltage value of supply voltage V1 (FIG. 1) in the active mode. In FIG. 2, the gap indicated by reference number 211 is the voltage difference between V4 and V3. Thus, when V4 is about 1.3 volts and V3 is about 1.25 volts, the voltage difference 211 is about one-half (½) volt. In some embodiments, V4 is selected to be between about 1.3 and about 1.5 volts and V3 is at a value such that voltage difference 211 is less than one-half volt. In other embodiments, V3 is selected to be a voltage between about 1.1 volts and about 1.3 volts when V4 is about 1.5 volts and V2 is zero. Other embodiments exist where V4 is greater than 1.5 volts and Vref is equal to or greater than 1.1 volts.

As described above in FIG. 2, it is possible to generate a reference voltage (Vref) having a value between 1.1 volts and 1.3 volts when a supply voltage (V1) is about 1.5 volts. It is possible in part because circuit 100 (FIG. 1) is constructed with a limited number of transistors in each of the paths 161 and 162 between nodes 151 and 152 in which V1 and V2 are applied. As shown in FIG. 1, each of the paths 161 and 162 includes only two transistors. For example, path 161 includes transistors 112 and 116; path 162 includes transistors 114 and 118. Thus, in FIG. 1, the limited number of transistors between supply nodes 151 and 152 allows Vref to be a voltage between about 1.1 volts and about 1.3 volts when V1 is about 1.5 volts.

Figure 3:
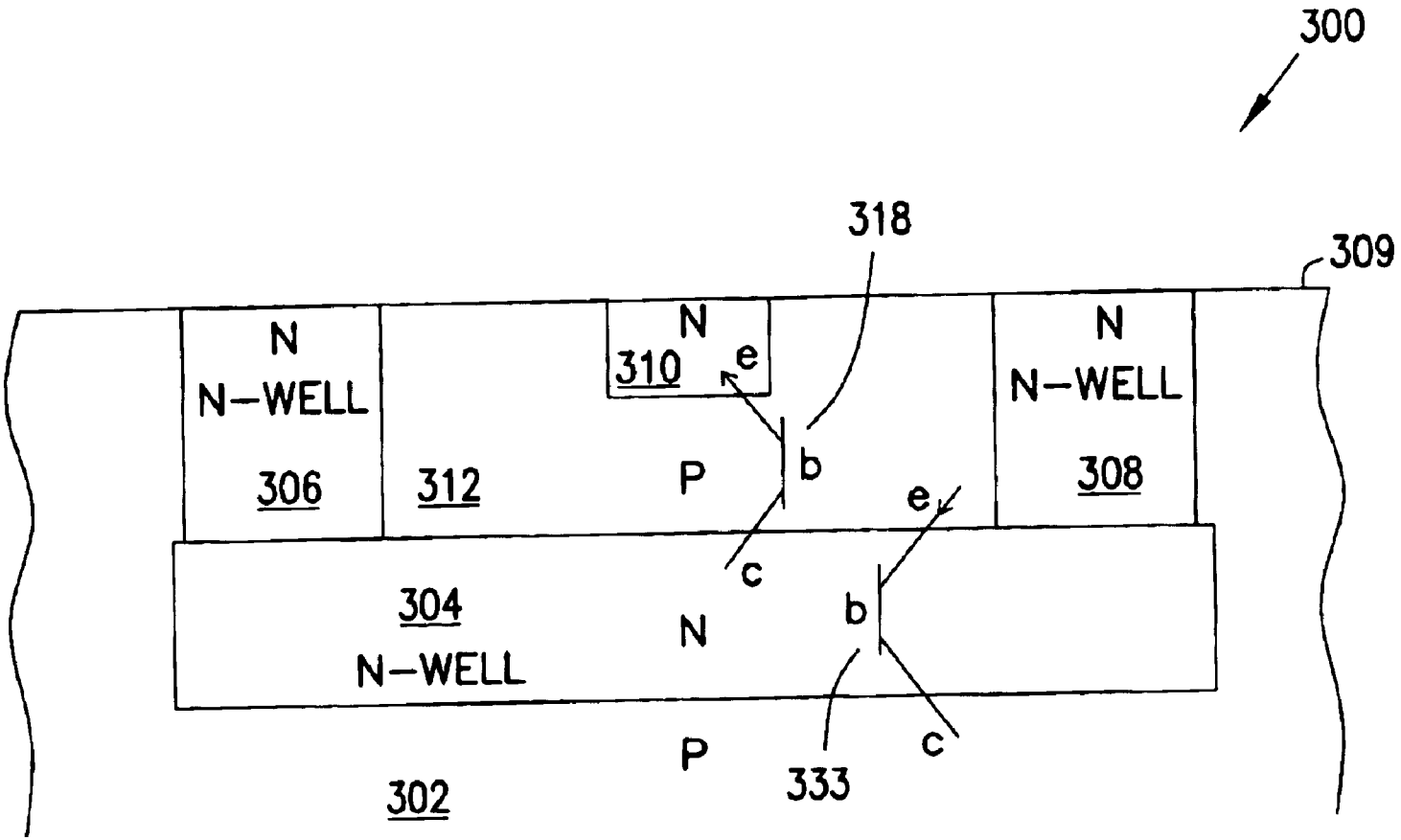
FIG. 3 shows a semiconductor die including a structure of a transistor of a reference circuit according to an embodiment of the invention.

FIG. 3 shows a semiconductor die including a structure of a transistor of a reference circuit according to an embodiment of the invention. Semiconductor die (or wafer) 300 can be a part of a device in which a reference circuit such as reference circuit 100 (FIG. 1) resides. Semiconductor die 300 includes a substrate 302, an N-well 304 buried in substrate 302, and two other N-wells 306 and 308 extended from a surface 309 to contact N-well 304. A region 310 is separated from N-wells 304, 306, and 308 by region 312. N-wells 304, 306, and 308 form a triple-well structure.

Labels "P" and "N" indicate different conductivity types of regions within semiconductor die 300. For example, regions 304, 306, 308, and 310 are N-type conductivity regions; regions 302 and 312 are P-type conductivity regions. A certain combination of these N-type and P-type conductivity regions forms a transistor. For example, regions 310, 312, and 304 form a bipolar NPN transistor, which is shown symbolically as transistor 318 in which "e", "b", and "c" represent the emitter, base, and collector, respectively. As another example, regions 312, 304, and 302 form a bipolar PNP transistor, which is shown symbolically as transistor 333. Since transistors 318 and 333 are formed by regions arranged vertically (from a substrate to a surface), they are vertical bipolar transistors. Thus, transistor 318 is a vertical bipolar NPN transistor and transistor 334 is a vertical bipolar PNP transistor. Further, since transistor 318 is formed by a triple-well structure of N-type conductivity regions, transistor 318 is a NPN bi-polar transistor having a triple-well structure.

Referring back to FIG. 1, transistors 116, 118 and 134 can be constructed similarly to transistor 318 of FIG. 3. Thus, each of the transistors 116, 118 and 134 can be a vertical bipolar NPN transistor. In some embodiments, standby current in circuit 100 may be reduced when transistors 116, 118 and 134 are vertical bipolar transistors (not lateral bipolar transistors) such as one represented by transistor 318. In some cases, a lateral bipolar PNP transistor may inject a significant amount of charge into the substrate such as substrate 302 during operation. The charge from the injected current may need to be removed from the substrate.

Removing the charge increases the standby current. Vertical bipolar NPN transistors (such as transistors 116, 118, and 134) may inject a smaller charge into the substrate than lateral PNP transistors do. Thus, with vertical bipolar transistors, standby current may be reduced if the injected charge is removed.

Figure 4:
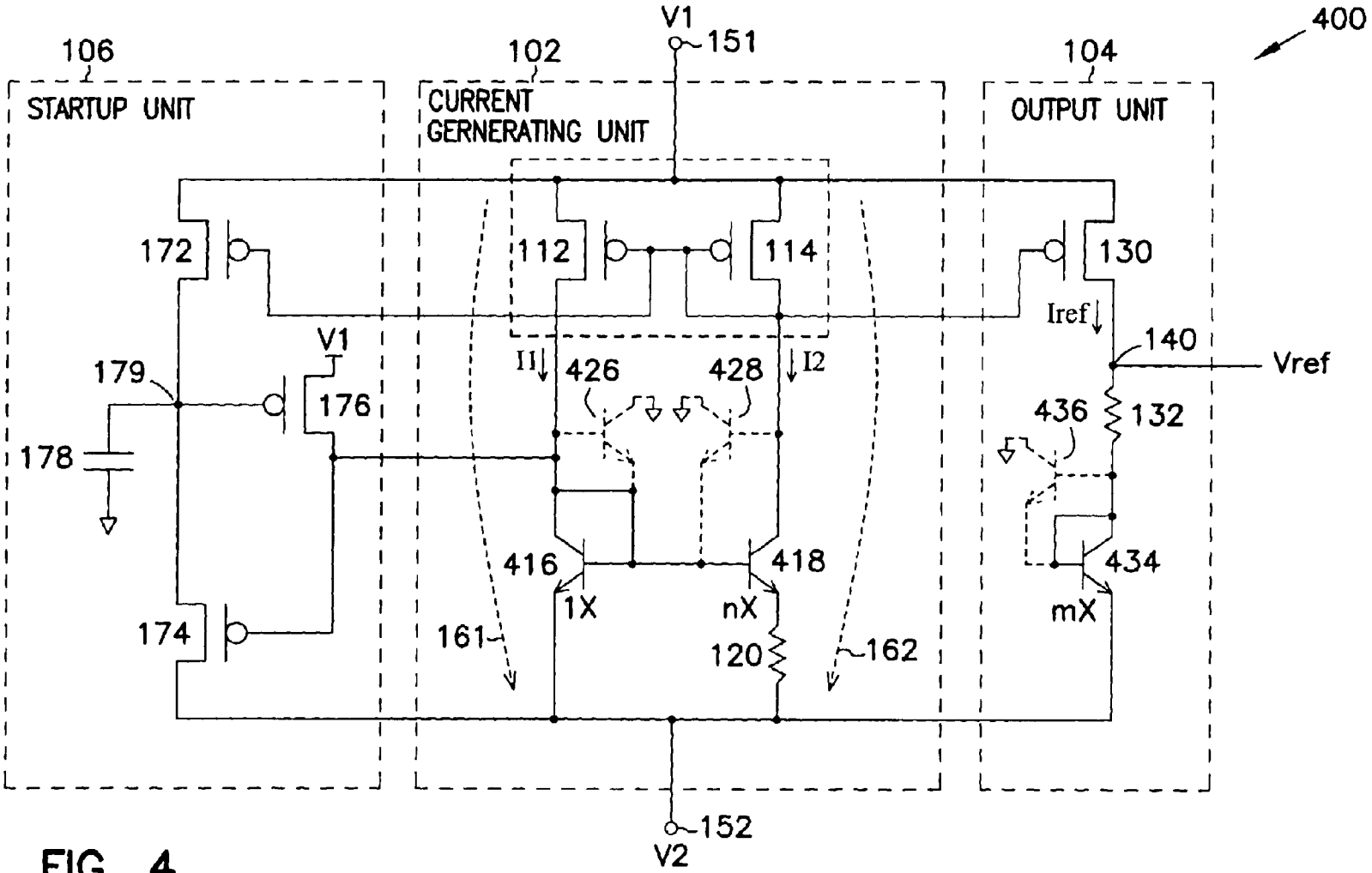
FIG. 4 shows a reference circuit having parasitic devices according to an embodiment of the invention.

FIG. 4 shows a reference circuit having parasitic devices according to an embodiment of the invention. Reference circuit 400 includes elements similar to that shown in FIG. 1 with the addition of transistors 426, 428, and 436; these transistors are shown in broken lines because they are not operative when reference circuit 400 is operative. Thus, transistors 426, 428, and 436 are parasitic transistors. The other transistors 416, 418, and 434 are similar to transistors 116, 118, and 134 (FIG. 1). In some embodiments, each of the transistor pairs 416 and 426, 418 and 428, and 434 and 436 has a structure similar to the structure of the transistor pair 318 and 333 shown in FIG. 3. For example, transistor pair 418 and 428 of FIG. 4 can be constructed similarly to transistor pair 318 and 333 of FIG. 3 in which transistor 418 represents transistor 118 and transistor 333 represents the parasitic transistor 428.

Figure 5:
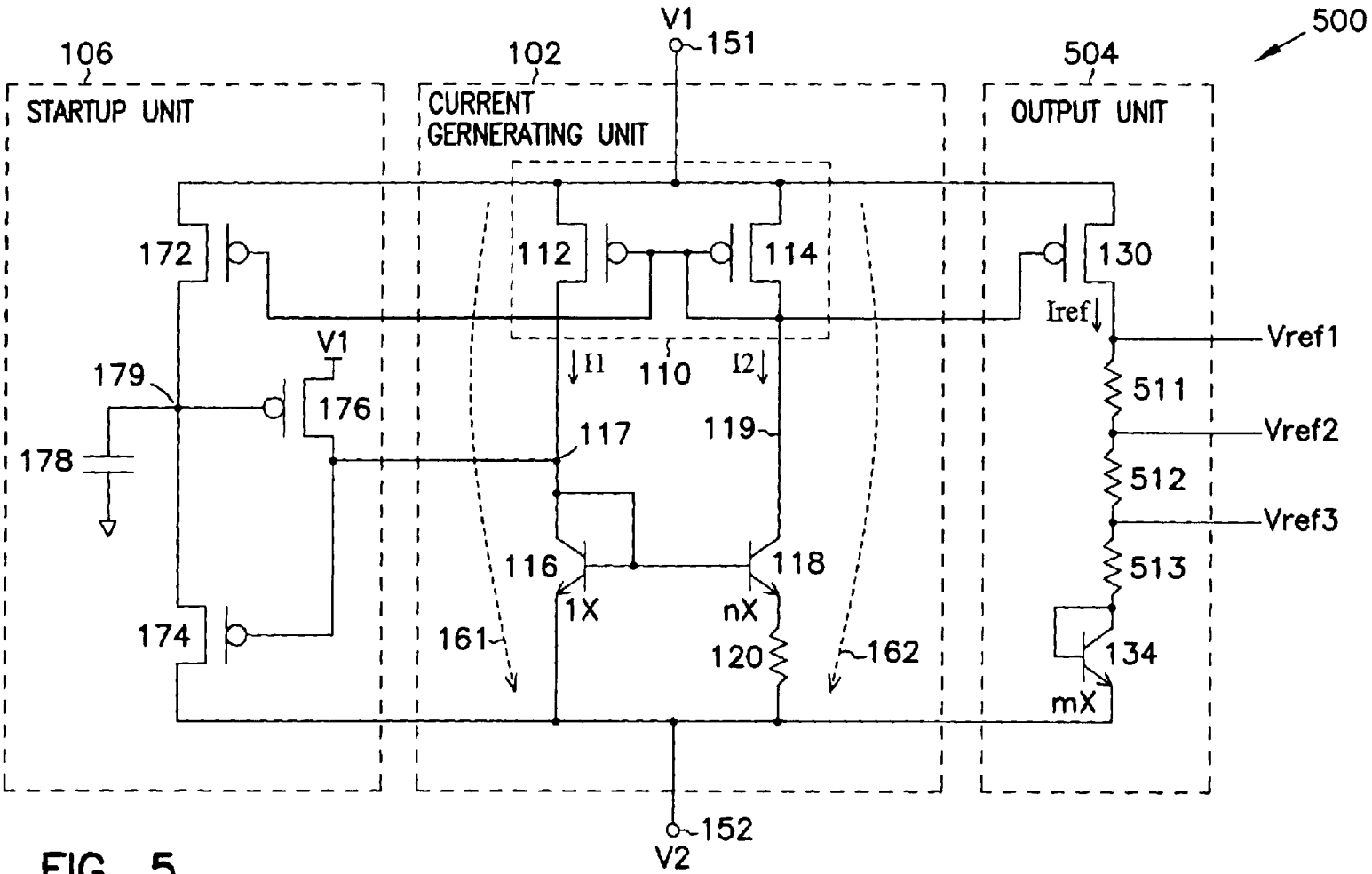
FIG. 5 shows a reference circuit having multiple reference voltages according to an embodiment of the invention.

FIG. 5 shows a reference circuit having multiple reference voltages according to an embodiment of the invention. Reference circuit 500 has elements similar to that of FIG. 1, except in output unit 504. In FIG. 5, output unit 504 includes multiple output resistors 511, 512, and 513 connected in series between transistor 130 and transistor 134 for generating multiple reference voltages Vref1, Vref2, and Vref3. Although FIG. 5 shows three reference voltages, any number of reference voltages can be produced by increasing or decreasing the number of the output resistors.

Figure 6:
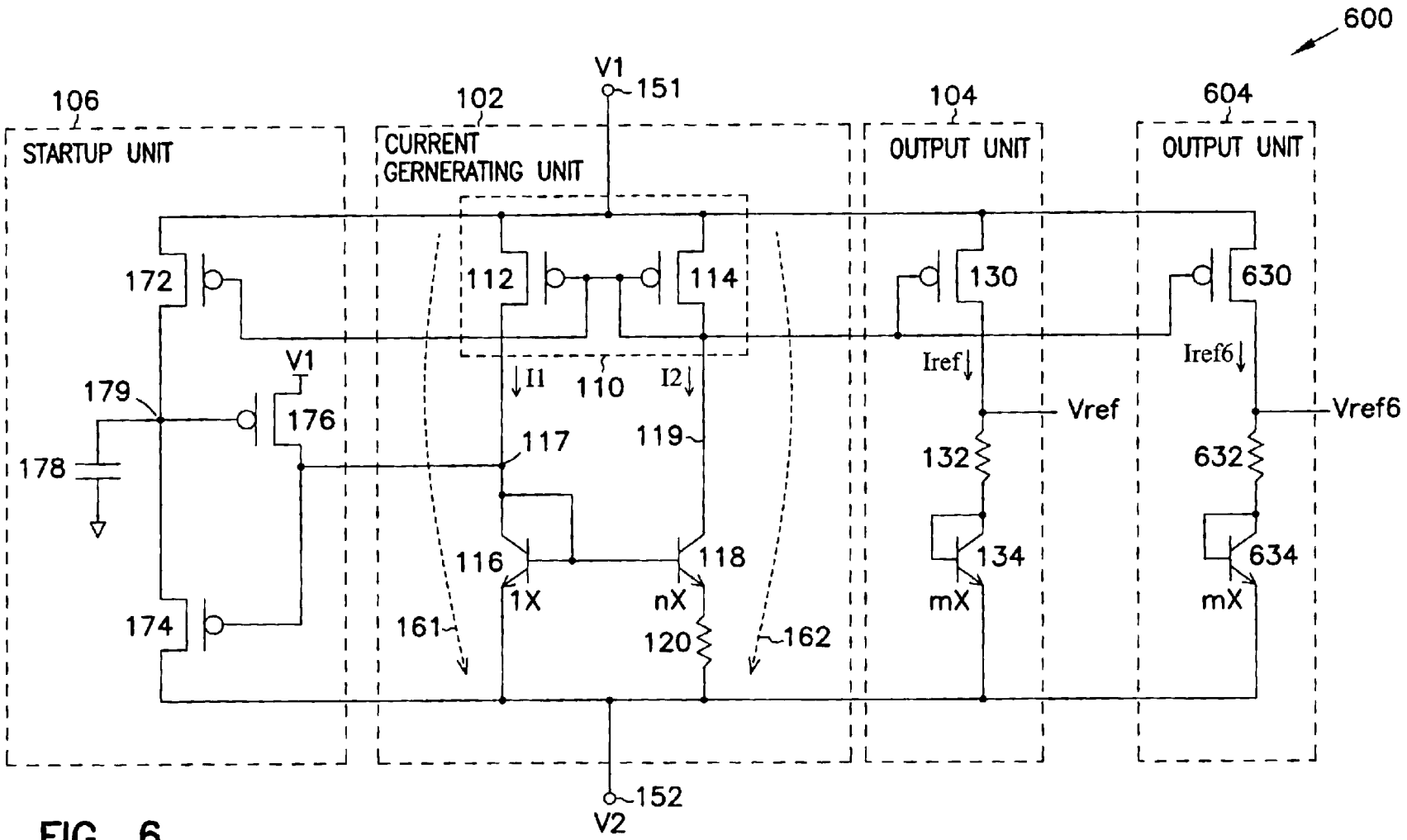
FIG. 6 shows an alternative reference circuit having multiple reference voltages according to an embodiment of the invention.

FIG. 6 shows an alternative reference circuit having multiple reference voltages according to an embodiment of the invention. Reference circuit 600 has elements similar to that of FIG. 1, except an additional output unit 604 for generating an additional reference voltage Vref6. Output unit 604 includes elements similar to the elements of output unit 104. Output unit 604 includes transistors 630 and 634, and resistor 632. Output unit 604 connects to current mirror 110 to produce a second reference current Iref6 to generate a second reference voltage Vref6. In some embodiments, transistor 630 is sized such that Iref6 is related to I2 and is unequal to Iref1 so that Vref6 is unequal to Vref1.

Figure 7:
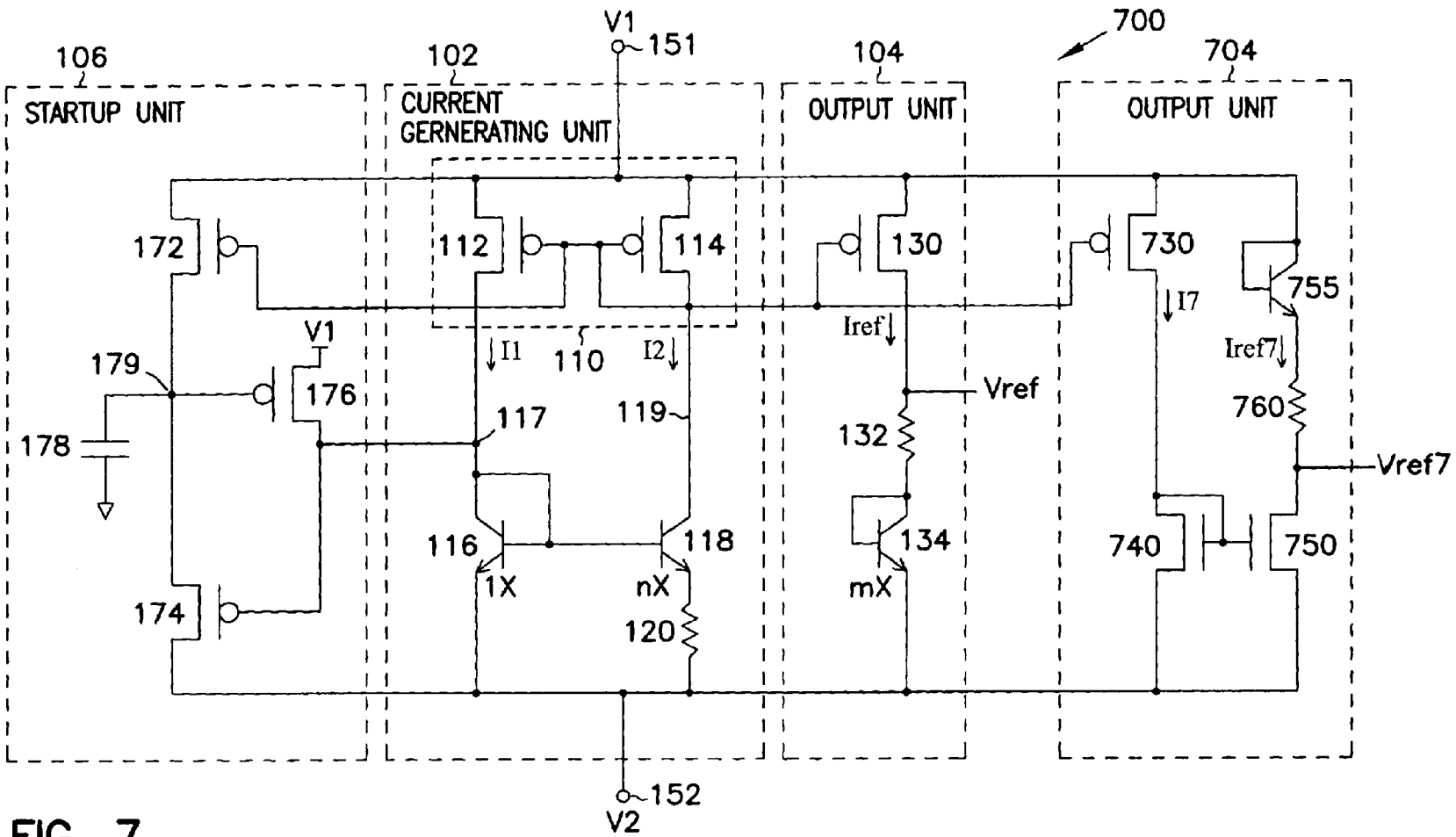
FIG. 7 shows a reference circuit having multiple reference voltages referenced to different supply voltages according to an embodiment of the invention.

FIG. 7 shows a reference circuit having multiple reference voltages referenced to multiple voltage rails according to an embodiment of the invention. Reference circuit 700 has elements similar to that of FIG. 1, except an additional output unit 704 for generating an additional reference voltage Vref7. Output unit 704 includes transistors 730, 740, 750, and 755 and a resistor 760. Transistor 730 connects to current mirror 110 to produce a current I7. Transistors 740 and 750 form an output current mirror to generate a reference current Iref7 equal to current I7. Iref7 flows through resistor 760 to generate Vref7.

Reference circuit 700 simultaneously generates two reference voltages: one referenced to one supply voltage (or voltage rail) and one referenced to another supply voltage (or another voltage rail). For example, when V1 is a positive supply voltage and V2 is a negative supply voltage (or ground), Vref is generated relative to V2 because Iref flows through resistor 132 connected to V2; Vref7 is generated relative to V1 because resistor 760 connects to V1.

Many variations of circuits in FIG. 1, and FIG. 4–FIG. 7 exists. For example, in FIG. 1, p-channel transistors 112, 114 and 130 can be replaced by n-channel transistors (NMOSFET or NMOS) and NPN bipolar transistors 116, 118, and 134 can be replaced with PNP bipolar transistors. Similarly, the p-channel transistors of FIG. 4–FIG. 7 can also be replaced by n-channel transistors and the NPN bipolar transistors can be replaced by PNP bipolar transistors.

Figure 8:
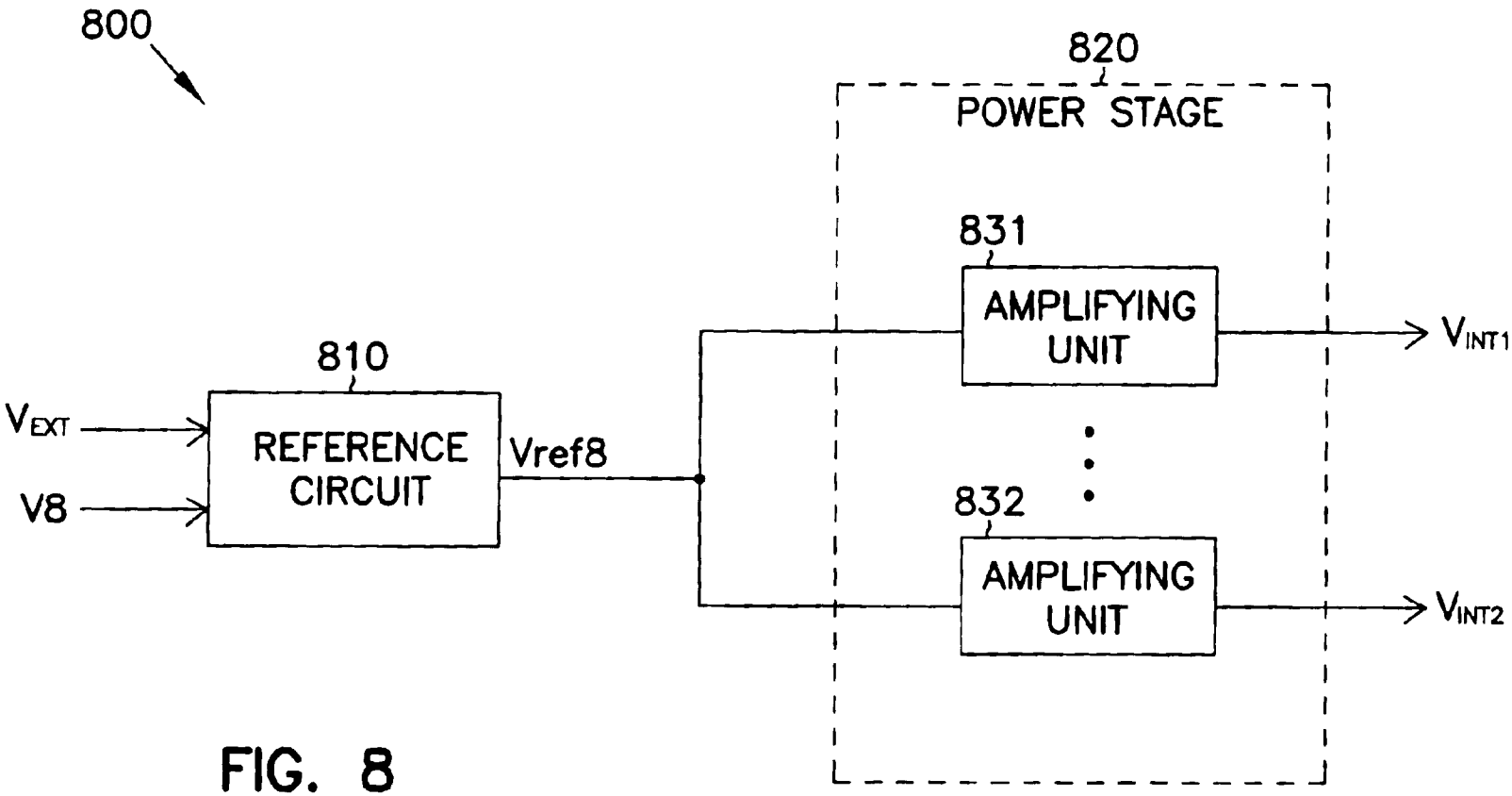
FIG. 8 shows a voltage regulator according to an embodiment of the invention.

FIG. 8 shows a voltage regulator according to an embodiment of the invention. Voltage regulator 800 includes a reference circuit 810 and a power stage 820. Reference circuit 810 can be any one of the reference circuits of FIG. 1, and FIG. 4–FIG. 7. Power stage 820 includes a plurality amplifying units 831 and 832. Power stage 820 shows two amplifying units as examples. However, the number of amplifying units can be any.

Reference circuit 810 receives supply voltages $V_{EXT}$ and V8. $V_{EXT}$ is similar to V1 and V8 is similar to V2 (FIG. 1). In some embodiments, $V_{EXT}$ is an external voltage provided to circuit 800 by an external source and V8 is ground. Reference circuit 810 generates a reference voltage Vref8 based on $V_{EXT}$ and V8. In some embodiments, Vref8 is a bandgap reference voltage similar to Vref (FIG. 1). Each of the amplifying units 831 and 832 receives Vref8 and generates an internal voltage. For example, amplifying unit 831 generates $V_{INT1}$; amplifying unit 832 generates $V_{INT2}$. $V_{INT1}$, and $V_{INT2}$ are amplified versions of Vref8. In some embodiments, $V_{INT1}$, and $V_{INT2}$ are smaller than $V_{EXT}$. In embodiments represented by FIG. 8, $V_{INT1}$, and $V_{INT2}$ are equal. In some embodiments, $V_{INT1}$, and $V_{INT2}$ can be unequaled. Voltage regulator 800 can be included in a device or in an integrated circuit to receive a supply voltage such as $V_{EXT}$ to generate a reference voltage such as Vref8. Voltage regulator 800 can also be included in a device or in an integrated circuit to generate at least one internal voltage such as $V_{INT1}$ and $V_{INT2}$ based on a reference voltage.

Figure 9:
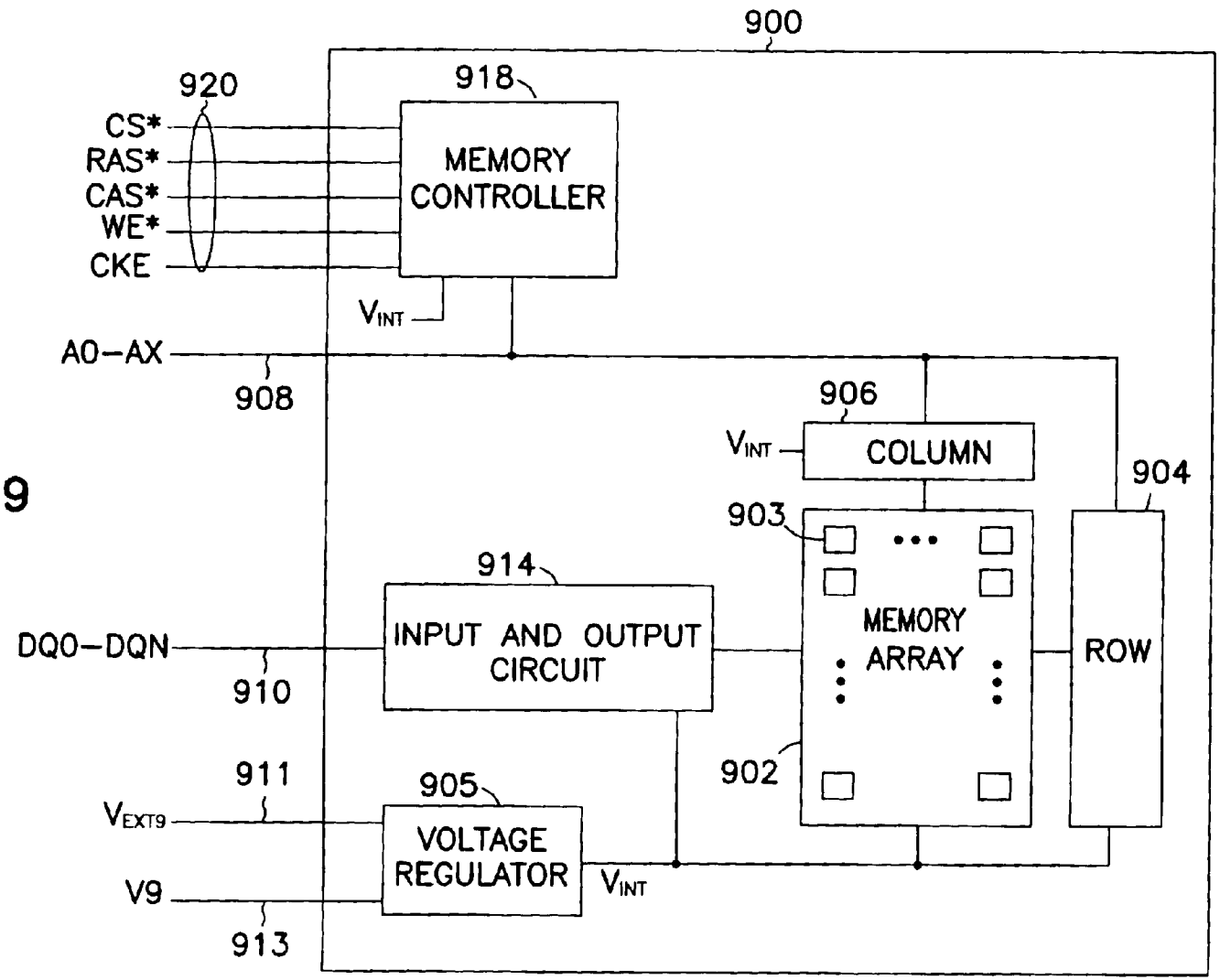
FIG. 9 shows a memory device according to an embodiment of the invention.

FIG. 9 shows memory device according to an embodiment of the invention. Memory device 900 includes a memory array 902 having a plurality of memory cells 903 arranged in rows and columns. Row decode 904 and column decode 906 access memory cells 903 in response to address signals A0 through AX (A0–AX), provided on address lines (or address bus) 908. A data input and output circuit path 914 transfers data between memory array 902 and data lines (or data bus) 910. Data signals DQ0 through DQN (DQ0–DQN) represent data transferred to and from memory array 902. A memory controller 918 controls the modes of operations of memory device 900 based on control signals on control lines 920. Examples of the control signals include a Chip Select signal CS*, a Row Access Strobe signal RAS*, a Column Access Strobe CAS* signal, a Write Enable signal WE*, and a Clock Enable signal CKE.

Memory device 900 further includes a voltage regulator 905 for generating at least one internal voltage $V_{INT}$ based on supply voltages $V_{EXT9}$ and V9 supplied to memory device 900 at nodes 911 and 913. Voltage regulator 905 can be voltage regulator 800 (FIG. 8) including a reference circuit such as reference circuit 810 (FIG. 8). Thus, voltage regulator 905 also includes a reference circuit such as any one of the reference circuits shown in FIG. 1, and FIG. 4–FIG. 7.

In FIG. 9, $V_{EXT9}$ is similar to V1 (FIG. 1) or $V_{EXT}$ (FIG. 8), V9 is similar to V2 (FIG. 1) or V8 (FIG. 8), and $V_{INT}$ is similar to $V_{INT1}$ or $V_{INT2}$ (FIG. 8). $V_{INT}$ is used as a supply voltage for memory array 902 and the peripheral circuits (circuit other than memory array 902). In embodiments where voltage regulator 905 includes multiple internal voltages such as $V_{INT1}$ and $V_{INT2}$, one of the internal voltages (e.g., $V_{INT1}$) can be used to supply a voltage to memory array 902 and another one of the internal voltages (e.g., $V_{INT2}$) can be used to supply a voltage to the peripheral circuits.

Memory device 900 can be a dynamic random access memory (DRAM) device. Examples of DRAM devices include synchronous DRAM commonly referred to as SDRAM, SDRAM II, SGRAM (Synchronous Graphics Random Access Memory), DDR SDRAM (Double Data Rate SDRAM), DDR II SDRAM, DDR III SDRAM, GDDR III SDRAM (Graphic Double Data Rate), and Rambus DRAMs. Memory device 900 can also be a static random access memory (SRAM) device, or can be a flash memory. Memory device 900 includes other elements, which are not shown for clarity.

Figure 10:
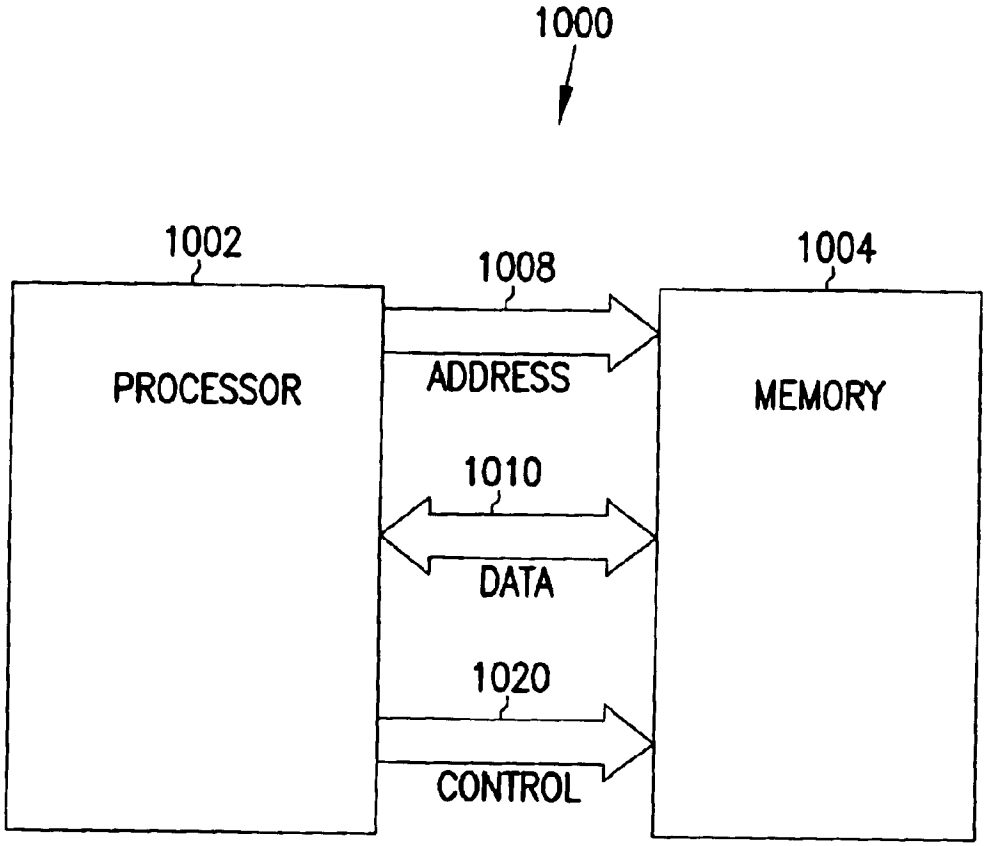
FIG. 10 shows a system according to an embodiment of the invention.

FIG. 10 shows a system 1000 according to an embodiment of the invention. System 1000 includes a first integrated circuit (IC) 1002 and a second IC 1004. ICs 1002 and 1004 can include processors, controllers, memory devices, application specific integrated circuits, and other types of integrated circuits. In embodiments represented by FIG. 10, for example, IC 1002 represents a processor and IC 1004 represents a memory device. Processor 1002 and memory device 1004 communicate using address signals on lines 1008, data signals on lines 1010, and control signals on lines 1020.

Memory device 1004 can be memory device 900 of FIG. 9. Thus, memory device 1004 can include a reference circuit such as any one of the reference circuits shown in FIG.1, and FIG.4–FIG. 7.

System 1000 represented by FIG. 10 includes computers (e.g., desktops, laptops, hand-helds, servers, Web appliances, routers, etc.), wireless communication devices (e.g., cellular phones, cordless phones, pagers, personal digital assistants, etc.), computer-related peripherals (e.g., printers, scanners, monitors, etc.), entertainment devices (e.g., televisions, radios, stereos, tape and compact disc players, video cassette recorders, camcorders, digital cameras, MP3 (Motion Picture Experts Group, Audio Layer 3) players, video games, watches, etc.), and the like.

CONCLUSION

Various embodiments of the invention provide techniques to generate a reference voltage from a supply voltage. The reference voltage is independent from variations in the supply voltage, from a range of temperature, and from manufacturing process variations.

Although specific embodiments are described herein, those skilled in the art recognize that other embodiments may be substituted for the specific embodiments shown to achieve the same purpose. This application covers any adaptations or variations of the present invention. Therefore, the present invention is limited only by the claims and all available equivalents.

What is claimed is:

1. A circuit comprising:

a first supply node for receiving a first supply voltage and a second supply node for receiving a second supply voltage;

a current mirror connected to the first supply node for providing a first current to a first internal node and a second current to a second internal node;

a first control transistor connected between the first internal node and a second supply node, the first control transistor and a portion of the current mirror forming a path between the first and second supply nodes, wherein the path includes only two transistors;

a second control transistor and a resistive element connected in series between the second internal node and the second supply node;

an output unit connected to the current mirror, the output unit including at least one output node for providing at least one reference voltage independent from variations in one of the first and second voltages and independent from variations in a temperature range, wherein the reference voltage includes a stable voltage level when one of the first and second supply nodes includes a voltage of about 1.3 volts to about 1.5 volts; and a startup unit connected to the first and second current source transistors and the first and second control transistors for influencing the first current and the second current.

2. The circuit of claim 1, wherein the current mirror includes metal oxide semiconductor transistors.

3. The circuit of claim 2, wherein the first and second control transistors include bipolar transistors.

4. The circuit of claim 3, wherein the first and second control transistors have unequal sizes.

5. The circuit of claim 1 further comprising at least one parasitic transistor connected between the current mirror and one of the first and second control transistors.

6. The circuit of claim 1, wherein the output unit includes:

an output transistor connected to the current mirror; and an output control transistor and an output resistive element connected in series between the output control transistor and the second supply node.

7. A circuit comprising:

a first supply node for receiving a first supply voltage and a second supply node for receiving a second supply voltage:

a current mirror connected to the first supply node for providing a first current to a first internal node and a second current to a second internal node;

a first control transistor connected between the first internal node and a second supply node, the first control transistor and a portion of the current mirror forming a path between the first and second supply nodes, wherein the path includes only two transistors;

a second control transistor and a resistive element connected in series between the second internal node and the second supply node; and an output unit connected to the current mirror, the output unit including at least one output node for providing at least one reference voltage independent from variations in one of the first and second voltages and independent from variations in a temperature range, wherein the reference voltage includes a stable voltage level when one of the first and second supply nodes includes a voltage of about 1.3 volts to about 1.5 volts, wherein the output unit includes an output transistor connected to the current mirror, and an output control transistor and an output resistive element connected in series between the output control transistor and the second supply node, wherein one of the first, second, and output control transistors is a vertical bipolar transistor having triple-well structure.

8. A circuit comprising:

a first supply node for receiving a first supply voltage and a second supply node for receiving a second supply voltage;

a current mirror connected to the first supply node for providing a first current to a first internal node and a second current to a second internal node;

a first control transistor connected between the first internal node and a second supply node, the first control transistor and a portion of the current mirror forming a path between the first and second supply nodes, wherein the path includes only two transistors;

a second control transistor and a resistive element connected in series between the second internal node and the second supply node;

a first output unit connected to the current mirror, the output unit including at least one output node for providing a first reference voltage independent from variations in one of the first and second voltages and independent from variations in a temperature range; and a second output unit connected to the current mirror for providing a second reference voltage.

9. A circuit comprising:

a first supply node for receiving a first supply voltage and a second supply node for receiving a second supply voltage;

a current mirror connected to the first supply node for providing a first current to a first internal node and a second current to a second internal node;

a first control transistor connected between the first internal node and a second supply node, the first control transistor and a portion of the current mirror forming a path between the first and second supply nodes, wherein the path includes only two transistors;

a second control transistor and a resistive element connected in series between the second internal node and the second supply node;

an output unit connected to the current mirror, the output unit including at least one output node for providing at least one reference voltage independent from variations in one of the first and second voltages and independent from variations in a temperature range;

a transistor connected to the current mirror; and an output current mirror connected to the transistor for providing a second reference voltage referenced to a voltage at the first supply node.

10. A circuit comprising:

a first supply node for receiving a first supply voltage and a second supply node for receiving a second supply voltage;

a current mirror connected to the first supply node for providing a first current to a first internal node and a second current to a second internal node;

a first control transistor connected between the first internal node and a second supply node, the first control transistor and a portion of the current mirror forming a path between the first and second supply nodes, wherein the path includes only two transistors;

a second control transistor and a resistive element connected in series between the second internal node and the second supply node;

an output unit connected to the current mirror, the output unit including at least one output node for providing at least one reference voltage independent from variations in one of the first and second voltages and independent from variations in a temperature range, wherein the reference voltage includes a stable voltage level when one of the first and second supply nodes includes a voltage of about 1.3 volts to about 1.5 volts; and a startup unit connected to the current mirror and the first and second control transistors for allowing the reference voltage to switch between a first stable voltage level and a second stable voltage level.

11. A circuit comprising:

a first supply node for receiving a first supply voltage and a second supply node for receiving a second supply voltage;

a current mirror connected to the first supply node for providing a first current to a first internal node and a second current to a second internal node;

a first control transistor connected between the first internal node and a second supply node, the first control transistor and a portion of the current mirror forming a path between the first and second supply nodes, wherein the path includes only two transistors;

a second control transistor and a resistive element connected in series between the second internal node and the second supply node;

an output unit connected to the current mirror, the output unit including at least one output node for providing at least one reference voltage independent from variations in one of the first and second voltages and independent from variations in a temperature range; and a startup unit connected to the current mirror and the first and second control transistors for allowing the reference voltage to switch between a first stable voltage level and a second stable voltage level, wherein the startup unit includes a capacitor and transistor combination connected to the first internal node for influencing the first and second currents.

12. A circuit comprising:

a first supply node and a second supply node;

a current generating unit connected to the first and second supply nodes for providing a generated current, the current generating unit including a current path connected between the first and second supply nodes, wherein the current path includes only two transistors; and an output unit connected to the current generating unit for receiving a version of the generated current for generating a first bandgap reference voltage and a second bandgap reference voltage different from the first bandgap voltage.

13. The circuit of claim 12, wherein the current generating unit includes:

a current mirror connected to the first supply node;

a first bipolar transistor connected to the current mirror and the second supply node; and a second bipolar transistor and a resistive element connected in series between the current mirror and the second supply node.

14. The circuit of claim 13, wherein the first and second bipolar transistors are NPN bipolar transistor.

15. The circuit of claim 14, wherein the first and second bipolar transistors have unequal sizes.

16. The circuit of claim 14, wherein the NPN bipolar transistors are vertical NPN bipolar transistors.

17. The circuit of claim 12 further comprising a startup unit connected to the current generating unit for allowing the at least one bandgap reference voltage to switch between a first stable voltage level and a second stable voltage level.

18. The circuit of claim 17, wherein the startup unit includes first transistor and a second transistor connected in series with the first transistor between the first and second supply nodes.

19. The circuit of claim 18, wherein the first transistor has a channel length greater than a channel length of the second transistor.

20. A circuit comprising:

a first supply node and a second supply node;

a current generating unit connected to the first and second supply nodes for providing a generated current, the current generating unit including a current path connected between the first and second supply nodes, wherein the current path includes only two transistors;

an output unit connected to the current generating unit for receiving a version of the generated current for generating at least one bandgap reference voltage; and a second output unit connected to the current generating unit for generating a second bandgap reference voltage.

21. A circuit comprising:

a first supply node and a second supply node;

a current generating unit connected to the first and second supply nodes for providing a generated current, the current generating unit including a current path connected between the first and second supply nodes, wherein the current path includes only two transistors;

an output unit connected to the current generating unit for receiving a version of the generated current for generating at least one bandgap reference voltage; and a second output unit connected to the current generating unit for generating a second bandgap reference voltage, wherein the second output unit includes an output current mirror.

22. A circuit comprising:

a first current source transistor having a source connected to a first supply node, a drain connected to a first internal node, and a gate connected to a second internal node;

a second current source transistor having a source connected to the first supply node, and a drain and a gate connected together at the second internal node;

a first control transistor having a base and a collector connected together at the first internal node, and an emitter connected to a second supply node;

a second control transistor having a base connected to the first internal node, a collector connected to the second internal node, and an emitter;

a first resistive element connected between the emitter of the second control transistor and the second supply node;

an output transistor having a source connected to the first supply node, a gate connected to the second internal node, and a drain connected to an output node to provide a reference voltage;

an output control transistor having a base and a collector connected together, and an emitter connected to the second supply node;

an output resistive element connected between the collector of the output control transistor and the output node; and a startup unit connected to the first and second current source transistors and the first and second control transistors for influencing currents sourced by the first and second source transistors.

23. The circuit of claim 22, wherein first and second source transistors include metal oxide semiconductor transistors.

24. The circuit of claim 23, wherein the first, second, and output control transistors are NPN bipolar transistors.

25. The circuit of claim 24, wherein the first control transistor has a first size, and a second control transistor has a second size greater than the first size.

26. A circuit comprising:

a first current source transistor having a source connected to a first supply node, a drain connected to a first internal node, and a gate connected to a second internal node;

a second current source transistor having a source connected to the first supply node, and a drain and a gate connected together at the second internal node;

a first control transistor having a base and a collector connected together at the first internal node, and an emitter connected to a second supply node;

a second control transistor having a base connected to the first internal node, a collector connected to the second internal node, and an emitter;

a first resistive element connected between the emitter of the second control transistor and the second supply node;

an output transistor having a source connected to the first supply node, a gate connected to the second internal node, and a drain connected to an output node to provide a reference voltage;

an output control transistor having a base and a collector connected together, and an emitter connected to the second supply node; and an output resistive element connected between the collector of the output control transistor and the output node, wherein the reference voltage includes a stable voltage level when one of the first and second supply nodes includes a voltage of about 1.3 volts to about 1.5 volts, wherein the first, second, and output control transistors are NPN bipolar transistors, and—has been added before "wherein";

wherein at least one of the NPN bi-polar transistors is a vertical NPN bi-polar transistor having a triple-well structure.

27. A circuit comprising:

a first current source transistor having a source connected to a first supply node, a drain connected to a first internal node, and a gate connected to a second internal node;

a second current source transistor having a source connected to the first supply node, and a drain and a gate connected together at the second internal node;

a first control transistor having a base and a collector connected together at the first internal node, and an emitter connected to a second supply node;

a second control transistor having a base connected to the first internal node, a collector connected to the second internal node, and an emitter;

a first resistive element connected between the emitter of the second control transistor and the second supply node;

an output transistor having a source connected to the first supply node, a gate connected to the second internal node, and a drain connected to an output node;

an output control transistor having a base and a collector connected together, and an emitter connected to the second supply node;

an output resistive element connected between the collector of the output control transistor and the output node; and a second output unit connected to the first and second supply nodes and the second internal nodes for providing a second reference voltage.

28. A circuit comprising:

a first current source transistor having a source connected to a first supply node, a drain connected to a first internal node, and a gate connected to a second internal node;

a second current source transistor having a source connected to the first supply node, and a drain and a gate connected together at the second internal node;

a first control transistor having a base and a collector connected together at the first internal node, and an emitter connected to a second supply node;

a second control transistor having a base connected to the first internal node, a collector connected to the second internal node, and an emitter;

a first resistive element connected between the emitter of the second control transistor and the second supply node;

an output transistor having a source connected to the first supply node, a gate connected to the second internal node, and a drain connected to an output node;

an output control transistor having a base and a collector connected together, and an emitter connected to the second supply node;

an output resistive element connected between the collector of the output control transistor and the output node; and a transistor and a current mirror combination connected to the first and second supply nodes and the second internal node for providing a second reference voltage referenced to a voltage at the first supply node.

29. A circuit comprising:

a first current source transistor having a source connected to a first supply node, a drain connected to a first internal node, and a gate connected to a second internal node;

a second current source transistor having a source connected to the first supply node, and a drain and a gate connected together at the second internal node;

a first control transistor having a base and a collector connected together at the first internal node, and an emitter connected to a second supply node;

a second control transistor having a base connected to the first internal node, a collector connected to the second internal node, and an emitter;

a first resistive element connected between the emitter of the second control transistor and the second supply node;

an output transistor having a source connected to the first supply node, a gate connected to the second internal node, and a drain connected to an output node to provide a reference voltage;

an output control transistor having a base and a collector connected together, and an emitter connected to the second supply node;

an output resistive element connected between the collector of the output control transistor and the output node, wherein the reference voltage includes a stable voltage level when one of the first and second supply nodes includes a voltage of about 1.3 volts to about 1.5 volts; and a startup unit connected to the first and second current source transistors and the first and second control transistors for influencing currents sourced by the first and second source transistors.

30. A circuit comprising:

a first current source transistor having a source connected to a first supply node, a drain connected to a first internal node, and a gate connected to a second internal node;

a second current source transistor having a source connected to the first supply node, and a drain and a gate connected together at the second internal node;

a first control transistor having a base and a collector connected together at the first internal node, and an emitter connected to a second supply node;

a second control transistor having a base connected to the first internal node, a collector connected to the second internal node, and an emitter;

a first resistive element connected between the emitter of the second control transistor and the second supply node;

an output transistor having a source connected to the first supply node, a gate connected to the second internal node, and a drain connected to an output node;

an output control transistor having a base and a collector connected together, and an emitter connected to the second supply node;

an output resistive element connected between the collector of the output control transistor and the output node;

a startup unit connected to the first and second current source transistors and the first and second control transistors for influencing currents sourced by the first and second source transistors, wherein the startup unit includes a capacitor and a first transistor combination connected to the first internal node for influencing the currents sourced by the first and second source transistors.

31. The circuit of claim 30, wherein the startup unit includes a second transistor connected to the capacitor and the first transistor.

32. The circuit of claim 31, wherein the startup unit further includes a third transistor connected in series with the second transistor between the first and second supply nodes.

33. The circuit of claim 32, wherein the third transistor has a channel length greater than a channel length of the second transistor.

34. A regulator comprising:

a reference circuit for receiving a supply voltage for generating a reference voltage; and a power unit connected to the reference circuit for generating at least one internal voltage, wherein the reference circuit includes:

a first supply node and a second supply node;

a current generating unit connected to the first and second supply nodes for providing a generated current, the current generating unit including a current path connected between the first and second supply nodes, wherein the current path includes only two transistors;

an output unit connected to the current generating unit for receiving a version of the generated current for generating the reference voltage; and a startup unit connected to the current generating unit for allowing the reference voltage to switch between a first stable voltage level and a second stable voltage level.

35. The regulator of claim 34, wherein the current generating unit includes:

a current mirror connected to the first supply node;

a first bipolar transistor connected to the current mirror and the second supply node; and a second bipolar transistor and a resistive element connected in series between the current mirror and the second supply node.

36. A regulator comprising:

a reference circuit for receiving a supply voltage for generating a reference voltage; and a power unit connected to the reference circuit for generating at least one internal voltage, wherein the reference circuit includes:

a first supply node and a second supply node;

a current generating unit connected to the first and second supply nodes for providing a generated current, the current generating unit including a current path connected between the first and second supply nodes, wherein the current path includes only two transistors;

an output unit connected to the current generating unit for receiving a version of the generated current for generating the reference voltage, wherein the reference voltage includes a stable voltage level when one of the first and second supply nodes includes a voltage of about 1.3 volts to about 1.5 volts; and a startup unit connected to the current generating unit for allowing the reference voltage to switch between a first stable voltage level and a second stable voltage level.

37. A regulator comprising:

a reference circuit for receiving a supply voltage for generating a reference voltage; and a power unit connected to the reference circuit for generating at least one internal voltage, wherein the reference circuit includes:

a first supply node and a second supply node;

a current generating unit connected to the first and second supply nodes for providing a generated current, the current generating unit including a current path connected between the first and second supply nodes, wherein the current path includes only two transistors; and an output unit connected to the current generating unit for receiving a version of the generated current for generating the reference voltage, wherein the reference voltage includes a stable voltage level when one of the first and second supply nodes includes a voltage of about 1.3 volts to about 1.5 volts, and wherein the power unit includes at least one amplifying unit for amplifying the reference voltage to generate the internal voltage.

38. A memory device comprising:

a memory array; and a voltage regulator connected to the memory array for supplying an internal voltage to the memory array, the voltage regulator including a reference circuit for generating a reference voltage to influence the internal voltage, the reference circuit including:

a first supply node and a second supply node;

a current generating unit connected to the first and second supply nodes for providing a generated current, the current generating unit including a current path connected between the first and second supply nodes, wherein the current path includes only two transistors; and an output unit connected to the current generating unit for receiving a version of the generated current for generating the reference voltage; and a startup unit connected to the current generating unit for allowing the reference voltage to switch between a first stable voltage level and a second stable voltage level.

39. The memory device of claim 38, wherein the current generating unit includes:

a current mirror connected to the first supply node;

a first bipolar transistor connected to the current mirror and the second supply node; and a second bipolar transistor and a resistive element connected in series between the current mirror and the second supply node.

40. A memory device comprising:

a memory array; and a voltage regulator connected to the memory array for supplying an internal voltage to the memory array, the voltage regulator including a reference circuit for generating a reference voltage to influence the internal voltage, the reference circuit including:

a first supply node and a second supply node;

a current generating unit connected to the first and second supply nodes for providing a generated current, the current generating unit including a current path connected between the first and second supply nodes, wherein the current path includes only two transistors;

an output unit connected to the current generating unit for receiving a version of the generated current for generating the reference voltage, wherein the reference voltage includes a stable voltage level when one of the first and second supply nodes includes a voltage of about 1.3 volts to about 1.5 volts; and a startup unit connected to the current generating unit for allowing the reference voltage to switch between a first stable voltage level and a second stable voltage level.

41. A memory device comprising:

a memory array; and a voltage regulator connected to the memory array for supplying at least one internal voltage to the memory array, the voltage regulator including a reference circuit for generating a reference voltage to influence the internal voltage, the reference circuit including:

a first supply node and a second supply node;

a current generating unit connected to the first and second supply nodes for providing a generated current, the current generating unit including a current path connected between the first and second supply nodes, wherein the current path includes only two transistors; and an output unit connected to the current generating unit for receiving a version of the generated current for generating the reference voltage, wherein the regulator further includes at least one amplifying unit for amplifying the reference voltage to generate the at least one internal voltage.

42. A system comprising:

a processor; and a memory device connected to the processor, the memory device including a memory array and a voltage regulator for providing an internal voltage to the memory array, the voltage regulator including a reference circuit, the reference circuit including:

a first supply node and a second supply node;

a current generating unit connected to the first and second supply nodes for providing a generated current, the current generating unit including a current path connected between the first and second supply nodes, wherein the current path includes only two transistors; and an output unit connected to the current generating unit for receiving a version of the generated current for generating multiple bandgap reference voltages.

43. The system of claim 42, wherein the current generating unit includes:

a current mirror connected to the first supply node;

a first bipolar transistor connected to the current mirror and the second supply node; and a second bipolar transistor and a resistive element connected in series between the current mirror and the second supply node.

44. The system of claim 42 further comprising a startup unit connected to the current generating unit for allowing the at least one of the multiple bandgap reference voltages to switch between a first stable voltage level and a second stable voltage level.

45. A system comprising:

a processor; and a memory device connected to the processor, the memory device including a memory array and a voltage regulator for providing at least one internal voltage to the memory array, the voltage regulator including a reference circuit, the reference circuit including:

a first supply node and a second supply node;

a current generating unit connected to the first and second supply nodes for providing a generated current, the current generating unit including a current path connected between the first and second supply nodes, wherein the current path includes only two transistors; and an output unit connected to the current generating unit for receiving a version of the generated current for generating at least one bandgap reference voltage, wherein the voltage regulator further includes at least one amplifying unit for amplifying the at least one bandgap reference voltage to generate the at least one internal voltage.

46. A method comprising:

generating a generated current in a current path of a current generating unit having elements with positive temperature coefficient and elements with negative temperature coefficient, the current path having only two transistors connected in series between a first supply node and a second supply node, wherein generating the generated current includes influencing the generated current allow the reference voltage to switch from a first stable voltage level to a second stable voltage level, and stopping the influencing the generated current when the reference voltage reaches the second stable voltage level;

generating at least one reference current based on the generated current; and generating at least one reference voltage based on the reference current.

47. The method of claim 46, wherein the at least one reference current and the generated current are proportional.

48. A method comprising:

generating a generated current in a current path of a current generating unit having elements with positive temperature coefficient and elements with negative temperature coefficient, the current path having only two transistors connected in series between a first supply node and a second supply node;

generating at least one reference current based on the generated current; and generating at least one reference voltage based on the reference current, wherein the reference voltage has a first stable voltage level and a second stable voltage level lower than the first stable voltage level, and wherein the reference voltage is at the first stable voltage level when one of the supply nodes has a voltage of about 1.3 volts.

49. The method of claim 48, wherein the first stable voltage level is a fixed voltage between about 1.1 volts and about 1.25 volts.

50. A method comprising:

generating a generated current in a current path of a current generating unit having elements with positive temperature coefficient and elements with negative temperature coefficient, the current path having only two transistors connected in series between a first supply node and a second supply node;

generating at least one reference current based on the generated current;

generating at least one reference voltage based on the one reference current; and generating a second reference voltage.

51. The method of claim 50 wherein generating the second reference voltage includes generating a second reference current based on the generated current.

52. The method of claim 50 wherein generating the second reference voltage includes:

mirroring the generated current to produce a mirrored current; and mirroring the mirrored current to generate the second reference current.

53. A method comprising:

generating a generated current in a current path of a current generating unit having elements with positive temperature coefficient and elements with negative temperature coefficient, the current path having only two transistors connected in series between a first supply node and a second supply node;

generating at least one reference current based on the generated current; and generating at least one reference voltage based on the reference current, wherein the reference voltage includes a stable voltage level when one of the first and second supply nodes includes a voltage of about 1.3 volts to about 1.5 volts, wherein generating the generated current includes:

influencing the generated current allow the reference voltage to switch from a first stable voltage level to a second stable voltage level; and stopping the influencing the generated current when the reference voltage reaches the second stable voltage level.

54. A method comprising:

sourcing a first current using a first transistor connected directly to a supply node;

passing the first current directly through a first control transistor connected directly to a second supply node;

sourcing a second current using a second transistor connected directly to the first supply node;

passing the second current directly through a combination of a second control transistor and a resistive element connected to the second supply node;

generating a reference current based on the first and second currents; and generating a reference voltage based on the reference current, wherein generating the reference voltage includes influencing the first and second current to allow the reference voltage to switch from a low stable voltage level to a high second stable voltage level, and stopping the influencing the first and second currents when the reference voltage reaches the high stable voltage level.

55. The method of claim 54, wherein the reference current and the first and second currents are proportional.

56. A method comprising:

sourcing a first current using a first transistor connected directly to a supply node;

passing the first current directly through a first control transistor connected directly to a second supply node;

sourcing a second current using a second transistor connected directly to the first supply node;

passing the second current directly through a combination of a second control transistor and a resistive element connected to the second supply node;

generating a reference current based on the first and second currents; and generating a reference voltage based on the reference current, wherein the reference voltage has a low stable voltage level and a high stable voltage level higher than the low stable voltage level, and wherein the reference voltage is at the high stable voltage level when one of the supply nodes has a voltage of about 1.3 volts.

57. The method of claim 56, wherein the high stable voltage level is a selected voltage in a range of about 1.1 volts to about 1.25 volts.

58. A method comprising:

sourcing a first current using a first transistor connected directly to a supply node;

passing the first current directly through a first control transistor connected directly to a second supply node;

sourcing a second current using a second transistor connected directly to the first supply node;

passing the second current directly through a combination of a second control transistor and a resistive element connected to the second supply node;

generating a reference current based on the first and second currents; and generating a reference voltage based on the reference current, wherein the reference voltage includes a stable voltage level when one of the first and second supply nodes includes a voltage of about 1.3 volts to about 1.5 volts, wherein generating the reference voltage includes:

influencing the first and second current to allow the reference voltage to switch from a low stable voltage level to a high second stable voltage level; and stopping the influencing the first and second currents when the reference voltage reaches the high stable voltage level.

59. A method comprising:

sourcing a first current using a first transistor connected directly to a supply node;

passing the first current directly through a first control transistor connected directly to a second supply node;

sourcing a second current using a second transistor connected directly to the first supply node;

passing the second current directly through a combination of a second control transistor and a resistive element connected to the second supply node;

generating a reference current based on the first and second currents; and generating a reference voltage based on the reference current; and generating a second reference voltage.

60. The method of claim 59, wherein reference voltage is referenced to a voltage at the first supply node.

61. The method of claim 60, wherein second reference voltage is referenced to a voltage at the second supply node.

* * * * *

UNITED STATES PATENT AND TRADEMARK OFFICE

CERTIFICATE OF CORRECTION

PATENT NO. : 6,933,769 B2
DATED : August 23, 2005
INVENTOR(S) : Koelling

It is certified that error appears in the above-identified patent and that said Letters Patent is hereby corrected as shown below:

Drawings,
Fig. 1, box 102, delete “GERNERATING” and insert -- GENERATING --.
Fig. 4, box 102, delete “GERNERATING” and insert -- GENERATING --.
Fig. 5, box 102, delete “GERNERATING” and insert -- GENERATING --.
Fig. 6, box 102, delete “GERNERATING” and insert -- GENERATING --.
Fig. 7, box 102, delete “GERNERATING” and insert -- GENERATING --.

Column 3,
Line 7, delete “12” and insert -- I2 --.

Column 8,
Lines 26, 27, 28 and 29, delete “$V_{INT1}$,” and insert -- $V_{INT1}$ --.

Column 10,
Line 36, delete “voltage:” and insert -- voltage; --.

Column 14,
Lines 36-37, after “and” delete “—has been added before “wherein” ;”.
Lines 38 and 39, delete “bi-polar” and insert -- bipolar --.

Signed and Sealed this

Tenth Day of January, 2006

JON W. DUDAS
*Director of the United States Patent and Trademark Office*